United States Patent [19]

Van Winkle

[11] 4,253,575

[45] Mar. 3, 1981

[54] RACK FOR TENNIS AND SIMILAR RACKETS

[76] Inventor: William Van Winkle, 41 Breezy Point, Little Silver, N.J. 07739

[21] Appl. No.: 71,299

[22] Filed: Aug. 30, 1979

[51] Int. Cl.[3] ..... A47F 7/00

[52] U.S. Cl. ..... 211/13; 211/87

[58] Field of Search ..... 211/13, 14, 60 R, 64, 211/65, 87; 248/304, 305, 306

[56] References Cited

U.S. PATENT DOCUMENTS

| | | | |
|---|---|---|---|
| 3,007,581 | 11/1961 | Moore | 211/64 |
| 3,537,595 | 11/1970 | Mathisen | 211/60 R |
| 3,858,725 | 1/1975 | Pietrack et al. | 211/13 |
| 4,116,340 | 9/1978 | Nelson | 211/13 |

*Primary Examiner*—James T. McCall
*Assistant Examiner*—Robert W. Gibson, Jr.
*Attorney, Agent, or Firm*—DeLio and Montgomery

[57] ABSTRACT

A rack for supporting one or more tennis rackets or the like in a position projecting edgewise outward from a wall, the rack having a resilient pad to engage one edge of the racket head, a base block on which the end of the rack handle may rest, and an L-shaped hook which engages the handle just below the throat and holds the racket head in resilient engagement with the pad.

12 Claims, 9 Drawing Figures

RACK FOR TENNIS AND SIMILAR RACKETS

This invention relates to a rack for supporting one or more tennis rackets or similar game implements, and particularly a rack which is mounted on a wall or other vertical surface and is used for storage, between uses, of a racket in a position wherein the racket extends in a plane perpendicular to the wall or at an oblique angle thereto.

Tennis rackets, when not in use, have long been recognized as presenting storage difficulties. Since standing on end in a corner of a room or closet is the least desirable location, efforts have been made to devise racks by which one or more rackets can be supported at a convenient height on the wall of any suitable room or closet. In such racks, it is customary to support the rackets in positions parallel to the wall, and the racks used in sporting goods stores (basically, a pair of parallel rods) function in this manner. For home use, a rack adapted to support four rackets in side-by-side pairs parallel to the wall is shown in Pietrack et al. U.S. Pat. No. 3,858,725, while hangers or holders for two rackets parallel to the wall are shown in Craven U.S. Pat. No. 4,108,312 and Nelson et al. U.S. Pat. No. 4,116,340.

In all such prior devices, the racks and rackets occupy substantial amounts of wall space and present the added inconvenience that only the outer racket (of two or more) is readily accessible. In the Craven and Nelson devices, the rackets cannot be provided with presses and even covers might not fit in. Either or both could be used in Pietrack's perforated shelf.

It is accordingly an object of the invention to provide a racket rack which holds a racket edgewise, projecting outward at a right or oblique angle to the wall.

It is another object to provide a racket rack which occupies minimal wall space.

It is a further object to provide a racket rack which can be used singly or as one of a set compactly but independently mounted.

It is yet another object to provide a racket rack wherein each racket is readily accessible without interference from rackets which may be supported on adjacent similar racks.

It is a still further object of the invention to provide certain improvements in the form, construction and arrangement of the several parts whereby the above-named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawing, wherein.

Figure 1:
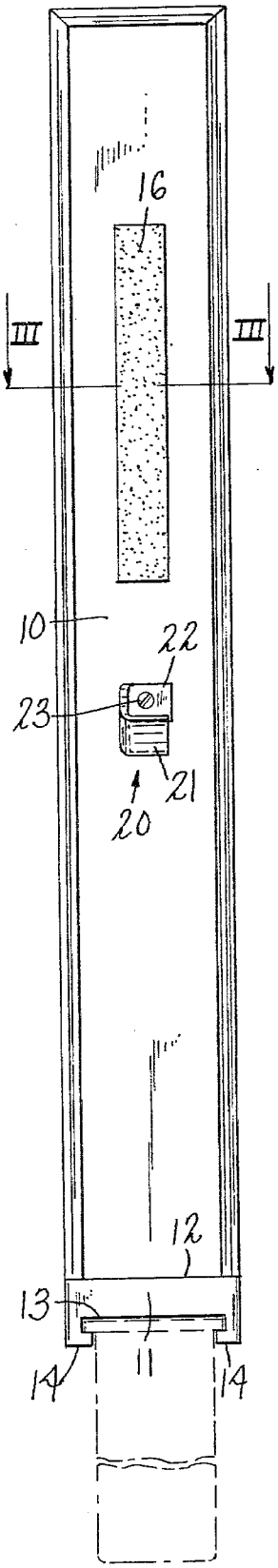
FIG. 1 represents a front elevation of the rack.
Figure 2:
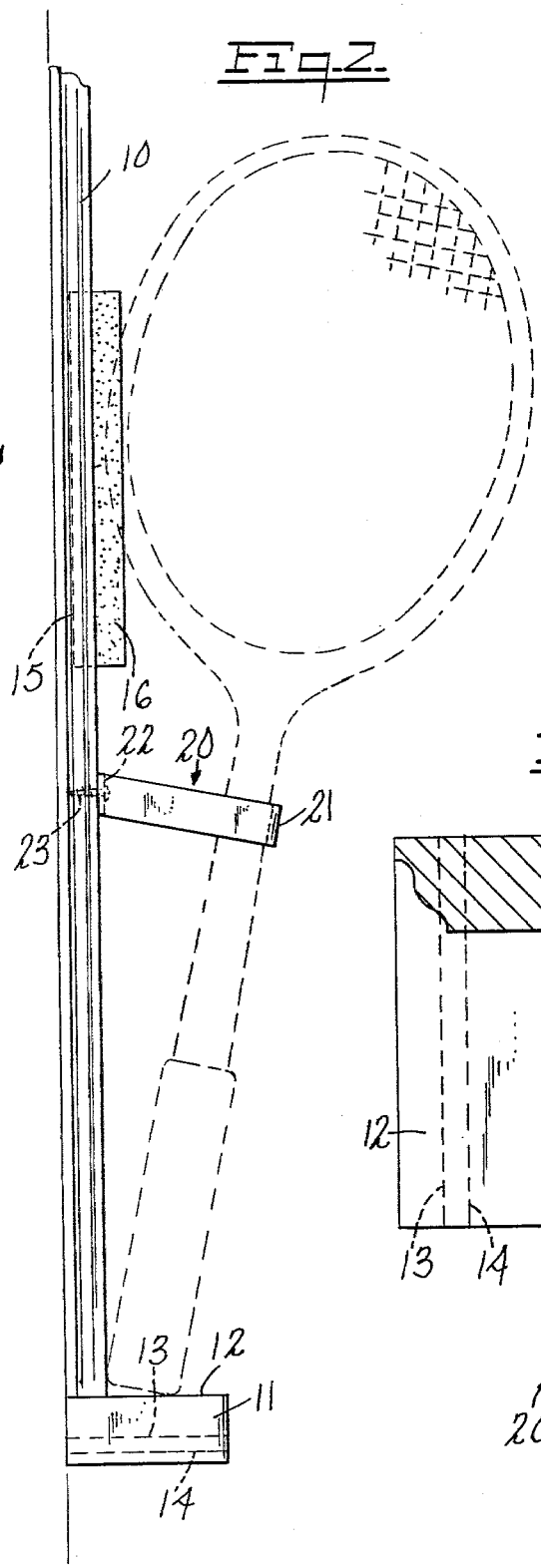
FIG. 2 represents a side elevation of the rack, a stored tennis racket being shown in broken lines.
Figure 3:
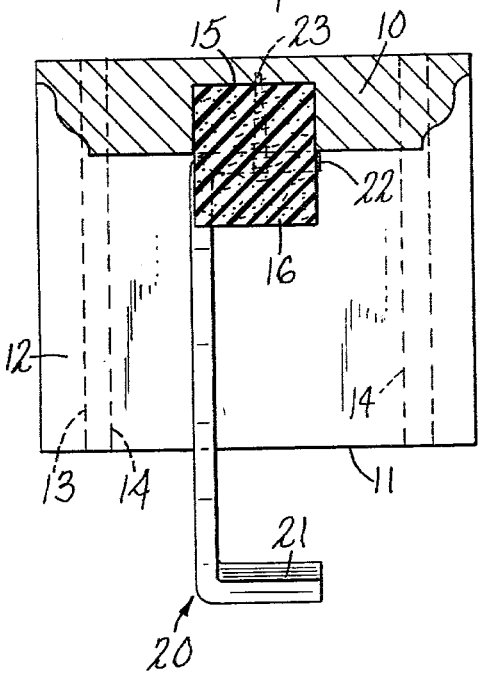
FIG. 3 represents a horizontal section on the line III—III of FIG. 1.

Referring to FIGS. 1 to 3, the rack comprises a back panel 10 which may suitably be a flat elongated board, wood or plywood, having a length approximately equal to the length of the racket to be supported, a width of about four inches and a thickness of about one inch. A base block 11 is screwed and/or glued to the lower end portion of the back panel, this block having a flat upper surface 12 and dimension, in plan, of about 4" by 3-½". The bottom surface 13 is laterally flanged, at 14, 14, to provide a track by which a can or cans of tennis balls can be supported. Since such cans vary slightly in the top lid or bead diameter, the track may suitably be tapered slightly in order to support a small range of can sizes. The rack is intended to be attached firmly to a wall in a vertical position but it could be mounted at any desired angle.

In its upper portion, the front face of the back panel is provided with a vertically elongated recess 15, shown as being about eight inches long and one inch wide with a depth which may be about half the thickness of the back panel. This recess constitutes a socket in which is fitted the back portion of a resilient compressible pad 16 of foam rubber or the equivalent, which should have a thickness up to one inch while still not projecting too far from the front surface of the panel 10. The width of the recess 15 and of the pad 16 should be somewhat greater than the thickness of the head of any racket to be supported; a width of about one inch meets this requirement with respect to normally sized rackets.

Below the pad 16, at a distance of 12" or 13" above the surface 12 of the base block, the rack is provided with a bracket 20, shown as a flat strong plastic strip formed into an L-shaped hook 21 with a base 22 fastened by a screw or screws 23 into the front face of the back panel. The strip projects at a downward angle such that the inner surface of the hook lies in a plane which intersects the surface 12. The length of the bracket 20 is calculated such that its hook portion can engage the racket handle, just below the throat, in a position to hold one edge of the head embedded in the pad 16 when the end of the handle is resting on the block 11 and against the back panel, all as shown in FIG. 2. It has been found that the dimensions of most tennis rackets are sufficiently uniform to permit this type of engagement in the rack illustrated, regardless of detail variations in the head shape, due to the compressibility of the pad 16. One exception is the so-called "Prince" head racket, for which a slightly longer bracket 20 can be provided.

Figure 4:
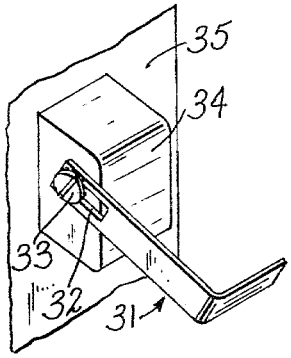
FIG. 4 represents a perspective view of an alternative form of bracket.

In the alternative form of brakcet shown in FIG. 4, the hook 31 is an L-shaped metal strip having a slot 32 near the end of its longer leg for adjustable securement by means of screw 33 to a block 34, attached to the back panel 35. This arrangement permits adjustment not only for spacing from the back panel, to ensure proper engagement of the racket head with the resilient pad, but also angular adjustment of the hook for proper bearing against the racket handle.

The manner of use of the rack is evident but may be described quite simply: the racket to be stored is placed with its handle end on the base block and rear corner against the back panel, the edge of the head resting against the pad 16 and the shank being on the open side of the bracket 20. The racket head is then pressed into the resilient pad far enough to permit engagement of the handle shank behind the hook 21. The resiliency of the pad compensates for variations in racket head sizes, as noted above, and holds the racket handle firmly against the hook, the surface of which may, if desired, be provided with a "non-skid" surface for additional security.

Figure 5:
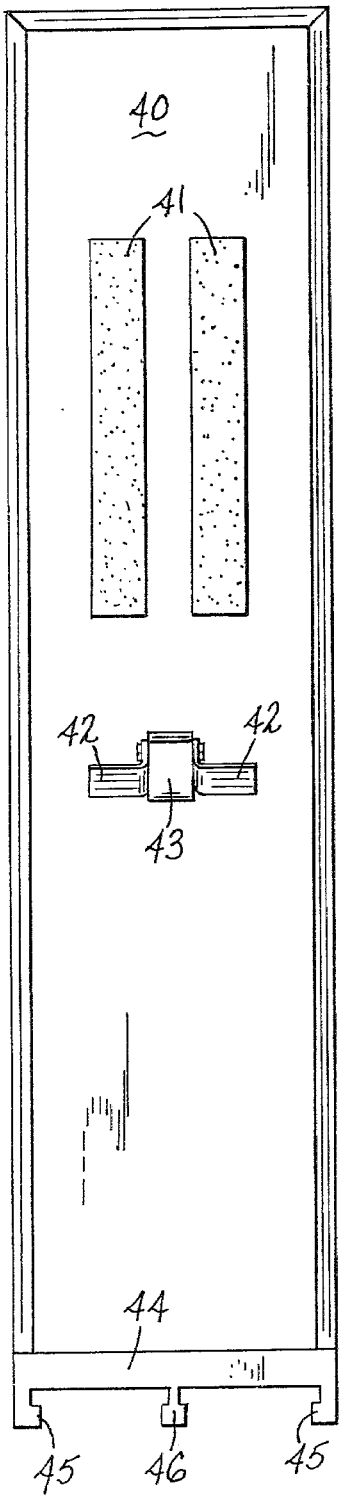
FIG. 5 represents a front elevation of a double rack.

While only a single unit is shown herein, it will be understood that two or more such racks can be mounted side by side with no additional spacing, or formed in a single common back panel. A double rack is shown in FIG. 5, wherein the back panel 40 is wider than the panel 10 and is provided with two resilient compressible pads 41, each corresponding to pad 16 and similarly mounted. The retaining hooks 42 are like the adjustable hook 31, shown in FIG. 4, and are mounted back-to-back on opposite sides of a single block 43. The base block 44 is similar to block 11 but its bottom is provided with lateral flanges 45 and an inverted T-shaped middle flange 46, providing parallel tracks for supporting cans of tennis balls.

Figure 6:
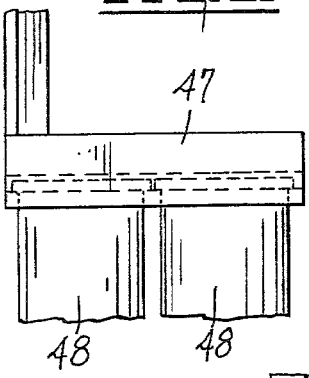
FIG. 6 represents a detail side elevation of a modified form of ball holder.
Figure 7:
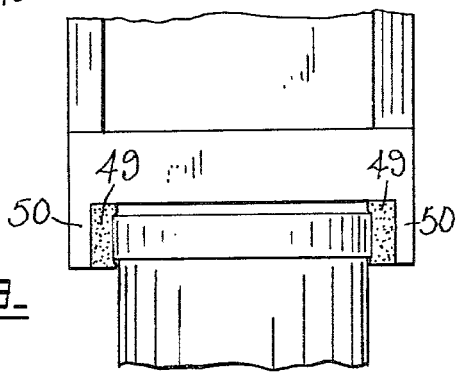
FIG. 7 represents a detail front elevation of another modified form of ball holder.

Either of the base block 11 or 44 can be made slightly longer, as shown at 47 in FIG. 6, to support two cans 48 instead of one.

The containers used for some game projectiles, such as badminton birds, are usually packed in tubes which have little or no bead or flange at either end. In a rack designed to support badminton rackets, the flanges 14 or 45 may be replaced by strips of resilient material 49 (like the pads 16 or 41) glued to the surfaces of plain flanges 50.

Figure 8:
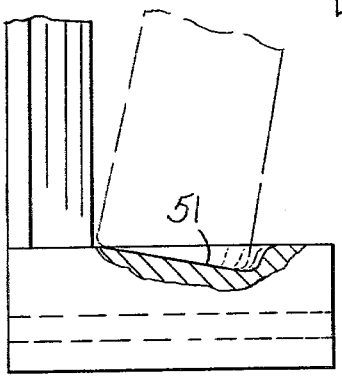
FIG. 8 represents a detail side elevation, partly broken away, of a modified form of base block.

Retention of the racket handle on the base block, in any case, can be made somewhat more secure by the provision of a beveled recess 51, as shown in FIG. 8. This adds to the expense of a wooden rack but could readily be included in a molded product, if deemed advisable.

Figure 9:
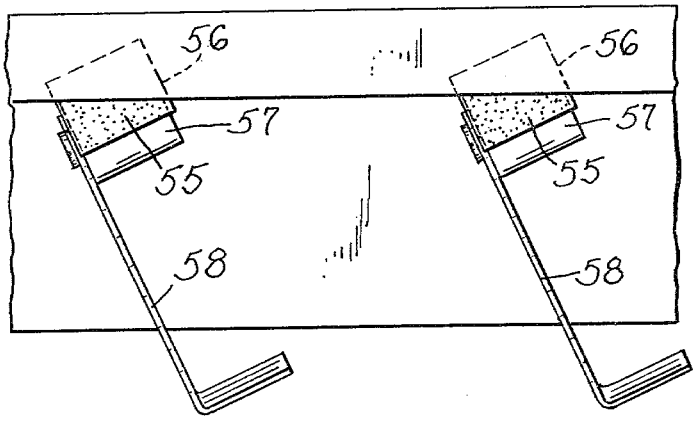
FIG. 9 represents a detail top plan view of a rack for supporting a plurality of rackets at oblique angles, the ends of the rack being broken away.

While a substantial advantage of the invention resides in its provision of means for supporting one or more rackets on minimal wall space, each racket projecting edgewise at a 90 degree angle to the wall, this specific supporting means can also be used to support a plurality, or multiplicity, of rackets for display in a very efficient manner by turning the pads and hook blocks a few degrees, as shown in FIG. 9. In this case, the pads 55 are set in angled recesses 56 and the blocks 57 are also set at an angle so that each hook 58 projects in a direction perpendicular to the surface of the respective pad. The back panel 60 and base block 61 may be made in any desired length and provided with as many pad and hook assemblies as desired, for installation on the wall of a sporting goods store, for instance. Each racket in such an array can be easily identified and removed for closer inspection without disturbing adjacent rackets. The lateral movement required to free a racket handle from the hook is very slight, so that angular movement of the head (with the pad as a pivot point) is no problem.

The racket head, in each instance, is in such a free position that it may be enclosed in a protective cover and/or braced with a press while still fitting securely in the rack. The side edges of the head normally project sufficiently beyond the sides of a press to permit engagement of the edges with the resilient pad, and if the press also touches the lower part of the pad, it merely provides additional resilient engagement.

The back panel is shown and described as being wood but other materials such as molded plastic or even metal could be used. The edge molding shown in the drawing is purely ornamental. This rack can be used, with suitable modification, for the support of racket-like implements of the types used in squash, racket ball, paddle tennis and other such sports, with the same advantages.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What I claim is:

1. A rack for supporting a racket-type game implement which has a flat, oval or rounded head portion, a straight elongated handle portion and a throat portion joining the head portion and the handle portion, the rack comprising an elongated narrow back panel adapted to be secured to a wall or the like in a generally vertical position, a base element fixed to the lower end portion of the back panel and presenting an upwardly facing support surface, a vertically elongated resilient compressible pad fixed to the upper portion of the back panel and a hook fixed to the back panel and extending from the surface thereof at a point below the pad, the hook including a portion which extends on a line substantially perpendicular to a plane which includes said hook portion and the longitudinal axis of the pad.

2. A rack according to claim 1 wherein the front surface of the back panel is recessed and the pad lies at least partially in said recess.

3. A rack according to claim 1 wherein the base element is a base block having a substantially flat upper surface.

4. A rack according to claim 3 wherein the base block has a laterally flanged bottom surface, the flanges being varyingly spaced.

5. A rack according to claim 1 wherein the hook is made from flat strap-like material, extending from the back panel in a downwardly sloped direction and being L-shaped in plan view.

6. A rack according to claim 1 wherein the hook is spaced from the base element a distance corresponding substantially to the distance from the end of the handle to a point just below the throat of the racket to be supported by the rack.

7. A rack according to claim 1 wherein the hook is fixed to the back panel by means of a screw mounting permitting adjustment of the hook's position.

8. A rack according to claim 1 wherein the hook is an L-shaped strip having an elongated slot adjacent the end of its longer leg and being adjustably attached to the back panel by means of a block on the panel and a screw in said slot.

9. A rack for supporting racket-type game implements which have flat, oval or rounded head portions, straight elongated handle portions, and throat portions joining the head portions and the handle portions, the rack comprising a flat back panel adapted to be secured to a wall or the like in a generally vertical position, a base element fixed to the lower edge of the back panel and presenting an upwardly facing support surface, a plurality of vertically elongated resilient compressible pads fixed to the upper portion of the back panel and a plurality of generally L-shaped hooks, each hook being fixed to the back panel and extending from the surface thereof at a point below a respective pad, each hook including a portion which extends on a line substantially perpendicular to a plane which includes said hook portion and the longitudinal axis of the pad.

10. A rack for supporting a pair of racket-type game implements which have flat, oval or rounded head portions, straight elongated handle portions and throat portions joining the head portions and the handle portions, the rack comprising an elongated narrow back panel adapted to be secured to a wall or the like in a generally vertical position, a base element fixed to the lower end portion of the back panel and presenting an upwardly facing support surface, a pair of vertically elongated resilient compressible pads fixed to the upper portion of the back panel and a pair of hooks fixed to the back panel and extending from the surface thereof at points below the respective pads, each hook including a portion which extends on a line substantially perpendicular to a plane which includes said hook portion and the longitudinal axis of a respective pad.

11. A rack according to claim 10 wherein each hook is fixed to the back panel by means of a screw mounting permitting adjustment of the hook's position.

12. A rack according to claim 11 wherein the hooks are mounted back to back on opposite sides of a single block attached to the back panel.

* * * * *